US007220527B2

(12) United States Patent
Asano et al.

(10) Patent No.: US 7,220,527 B2
(45) Date of Patent: May 22, 2007

(54) IMAGE FORMING APPARATUS AND AN IMAGE FORMING METHOD

(75) Inventors: Masao Asano, Tokyo (JP); Shigeki Takenouchi, Chofu (JP); Akihiko Itami, Hachioji (JP); Satoshi Uchino, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 341 days.

(21) Appl. No.: 10/862,307

(22) Filed: Jun. 7, 2004

(65) Prior Publication Data

US 2005/0271968 A1 Dec. 8, 2005

(51) Int. Cl.
*G03G 15/01* (2006.01)

(52) U.S. Cl. ..... 430/126; 399/302; 399/308; 399/159

(58) Field of Classification Search ..... 430/126; 399/302, 308, 159
See application file for complete search history.

(56) References Cited

U.S. PATENT DOCUMENTS

2003/0180646 A1* 9/2003 Asano et al. ..... 430/126

* cited by examiner

*Primary Examiner*—Mark A. Chapman
(74) *Attorney, Agent, or Firm*—Lucas & Mercanti, LLP

(57) ABSTRACT

An image forming apparatus, comprising: an electrophotographic photoreceptor and an intermediate transfer member, wherein the photoreceptor and the intermediate transfer member have a condition represented by Formula 1:

$$Wa<Wb$$

where Wa represents a water content (wt %) on the surface of the photoreceptor and Wb represents a water content (wt %) on the surface of the intermediate transfer member.

19 Claims, 4 Drawing Sheets

IMAGE FORMING APPARATUS AND AN IMAGE FORMING METHOD

BACKGROUND

1. Field of the Invention

The invention relates to an image forming apparatus and an image forming method used for a copy machine, a printer, a facsimile, and the like.

2. Description of Related Art

There is known an image forming system, the system using an intermediate transfer member, in which a transfer process of transferring a toner image from an electrophotographic photoreceptor (hereinafter, also referred to merely as 'photoreceptor') to a recording material incorporates another transfer process, wherein the toner image is primarily transferred from the electrophotographic photoreceptor to the intermediate transfer member, then the primary transfer image in the intermediate transfer member is secondarily transferred to the recording member, thereby the image forming system obtaining a final image. An intermediate transfer system as described above is mostly employed as a superimposing transfer system that superimposes toner images of respective colors in a so-called full color image forming apparatus, wherein the superimposing transfer system reproduces an original image, the original image having been color-separated, with use of a subtractive mixture of toners of black, cyan, magenta, yellow, etc.

However, when a large number of document sheets is copied or printed, toner filming occurs on an electrophotographic photoreceptor and an intermediate transfer member; the surface energy of the electrophotographic photoreceptor and the intermediate transfer member grows and the adhesion force to toner increases; transferability of the toner from the electrophotographic photoreceptor or the intermediate transfer member to a recording material is reduced; and thus, image defects easily occur on a final image. An image forming system using an intermediate transfer member has two transfer processes, which are a transfer process, as primary transfer means, that performs a primary transfer of a toner image from an electrophotographic photoreceptor to the intermediate transfer member, and another transfer process, as secondary transfer means, that transfers the toner image from the intermediate transfer member to a recording material. Since such an image forming system has two transfer processes as described above, degradation of transferability remarkably degrades the quality of final images.

Concretely, if transferability of toners degrades in an image forming system using an intermediate transfer member, a problem that a part of a toner image is not transferred, that is, so-called "hollow defects" or "character blurring" occurs.

For improvement of transferability which may cause "hollow defects" or "character blurring", prevention of toner filming, and improvement of incomplete cleaning, there has been discussion about technologies that provide micro particles in the surface layer of an electrophotographic photoreceptor, form irregularities on the surface thereof, reduce adhesion force of toner to the surface of the photoreceptor, improve transferability, and decrease friction force against a blade. In TOKKAI No. H05-181291, for example, it is reported that micro particles of alkyl sill sesqui oxane resin are provided in a photoreceptive layer. However, micro particles of alkyl sill sesqui oxane resin are hygroscopic, therefore, in a high moisture environment, wetness of the surface of a photoreceptor, that is, the surface energy increases, accordingly transferability decreases, and a result desired by the inventors is not obtained. In TOKKAI No. S63-56658, an electrophotographic photoreceptor provided with fluoride resin powder to lower the surface energy of the surface of a photoreceptor is reported. However, there is a problem that fluoride resin powder does not achieve enough surface strength, and streak defects due to scratches on the photoreceptor surface easily occur.

On the other hand, regarding improvement of the transferability of an intermediate transfer member, there are disclosed technologies that provide an intermediate transfer member with a solid lubricant to decrease the surface energy of the intermediate transfer member. For example, TOKKAI No. H06-337598, TOKKAI No. H06-332324, and TOKKAI No. H07-271142 disclose such technologies. Also, in TOKKAI NO. H03-242667 for example, there are presented methods in which elastomer is employed as an intermediate transfer member, and the surface roughness of the intermediate transfer member is specified so that the contactability between the intermediate transfer member and a transfer material is improved, thereby improving transferability. Further, in TOKKAI No. S63-194272, TOKKAI No. H04-303869, TOKKAI No. H04-303872, and TOKKAI No. H05-193020 for example, there are also presented methods of specifying the surface roughness of an intermediate transfer member to improve transferability.

However, such a control of the surface of an intermediate transfer member is not enough to improve total transferability of an image forming system using an intermediate transfer member and having two transfer processes. Particularly, when forming copy images in an environment of a high temperature and high humidity or for a long period, it is even less enough to improve "hollow defects" and "character blurring".

The inventors have discussed about presenting an image forming apparatus and an image forming method which improve transferability of toner in an image forming system, the image forming system using an intermediate transfer member, to prevent image defects such as "hollow defects" and "character blurring". As a result, regarding image defects of "hollow defects" and "character blurring" described above, the inventors have recognized that the relationship between the water content ratio of an electrophotographic photoreceptor and that of an intermediate transfer member is significantly related to the image defects. The inventors have recognized that image defects such as "hollow defects" and "character blurring" under a high humidity is closely related to the relative magnitude between the water content ratio of an electrophotographic photoreceptor and that of an intermediate transfer member, and if the magnitudes of the water content ratios are different, image defects such as "hollow defects" or "character blurring" easily occur.

SUMMARY

An image forming apparatus, comprising: an electrophotographic photoreceptor and an intermediate transfer member, wherein the photoreceptor and the intermediate transfer member have a condition represented by Formula 1:

$$Wa<Wb$$

where Wa represents a water content (wt %) on the surface of the photoreceptor and Wb represents a water content (wt %) on the surface of the intermediate transfer member.

DETAILED DESCRIPTION OF THE EXEMPLARY EMBODIMENTS

The invention will be described in details below.

Figure 1:
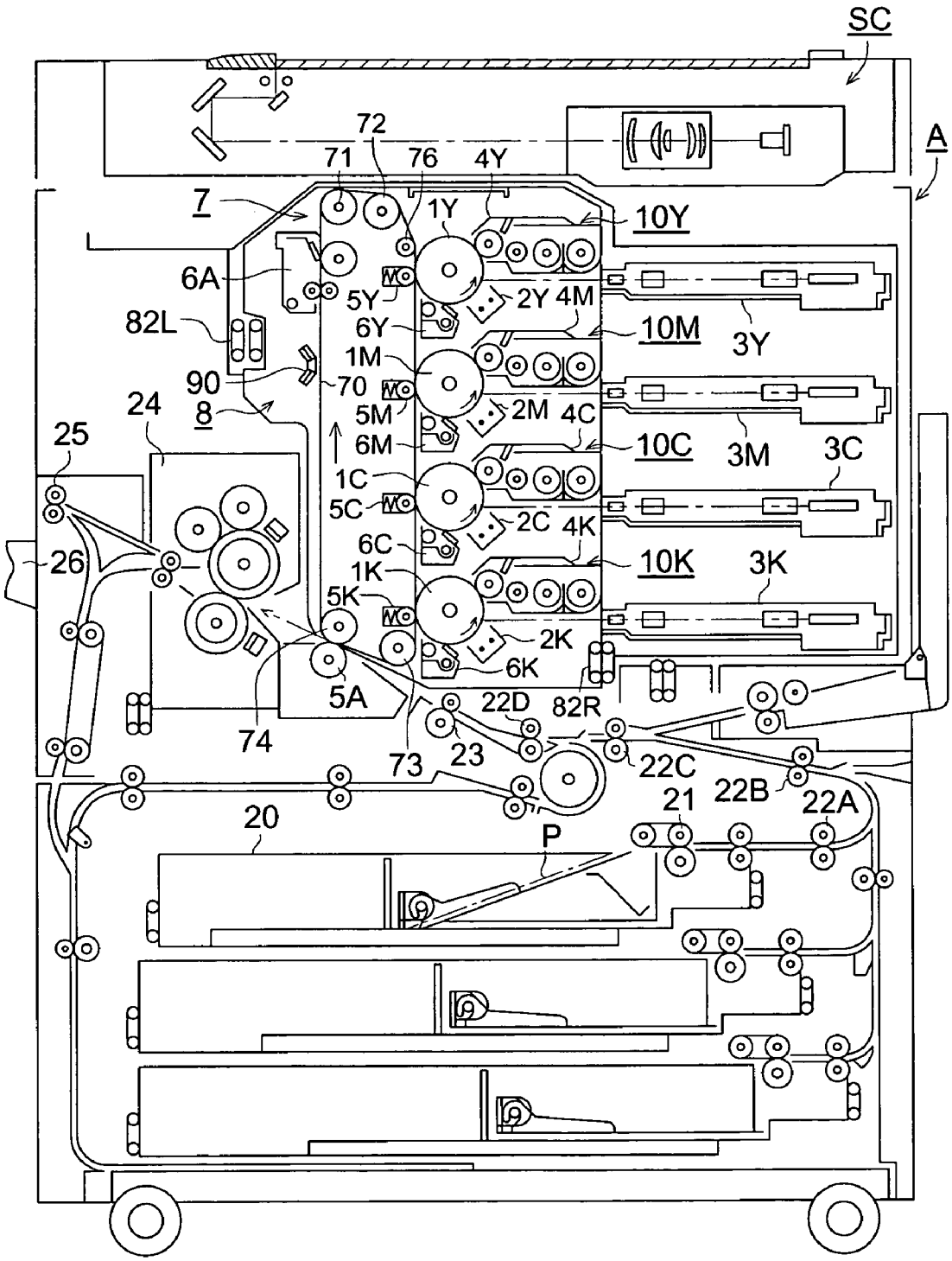
FIG. 1 is a cross-sectional construction diagram of a color image forming apparatus, showing an embodiment of the invention.

FIG. 1 is a cross-sectional construction diagram of a color image forming apparatus, showing an embodiment of the invention. This color image forming apparatus is called a tandem type color image forming apparatus and is comprised of a set of plurality of image forming sections 10Y, 10M, 10C, and 10K, endless-belt shape intermediate transfer unit 7, sheet convey device 21, and fixing device 24. Document image reading device SC is arranged on body A of the image forming apparatus.

The image forming section 10Y that forms yellow images is comprised of charging device 2Y, exposure device 3Y, developing device 4Y, primary transfer roller 5Y as primary transfer means, and cleaning device 6Y, which are arranged around drum shape photoreceptor 1Y as a first image carrier. The image forming section 10M that forms magenta images is comprised of drum shape photoreceptor 1M as a first image carrier, charging device 2M, exposure device 3M, developing device 4M, primary transfer roller 5M as primary transfer means, and cleaning device 6M. The image forming section 10C that forms cyan images is comprised of drum shape photoreceptor 1C as a first image carrier, charging device 2C, exposure device 3C, developing device 4C, primary transfer roller 5C as primary transfer means, and cleaning device 6C. The image forming section 10K that forms black images is comprised of drum shape photoreceptor 1K as a first image carrier, charging device 2K, exposure device 3K, developing device 4K, primary transfer roller 5K as primary transfer means, and cleaning device 6K.

The endless-belt shape intermediate transfer unit 7 is windingly circulated by a plurality of rollers and has second endless-belt shaped intermediate transfer member 70, as a second image carrier, that is circulatively supported, semiconductive, and in an endless-belt shape.

Images in respective colors formed by the image forming sections 10Y, 10M, 10C, and 10K are sequentially transferred onto the rotating endless-belt shape intermediate transfer member 70 by the primary transfer rollers 5Y, 5M, 5C, and 5K as primary transfer means so that a composite color image is formed. Sheet P as a recording medium received in sheet feeding cassette 20 is fed by sheet feeding device 21, conveyed to secondary transfer roller 5A as secondary transfer means through a plurality of intermediate rollers 22A, 22B, 22C, 22D, and registration roller 23, and then, the color image is secondarily transferred onto the sheet P in one-shot. The sheet P on which the color image has been transferred is fixed by fixing device 24, sandwiched by exit roller 25, and mounted on exit tray 26 outside the machine.

On the other hand, after the color image has been transferred to the sheet P by the secondary transfer roller 5A as the secondary transfer means, the endless-belt type intermediate transfer member 70, from which the sheet P has self-striped, is removed of residual toner by cleaning device 60A.

During the image forming processing, the primary transfer roller 5K is all the time pressed against the photoreceptor 1K. The other primary transfer rollers 5Y, 5M, and 5C are-pressed against the respective photoreceptors 1Y, 1M, and 1C only when the respective color images are formed.

The secondary roller 5A is pressed against the endless-belt shape intermediate transfer member 70 in contact therewith only when the sheet P passes through between them and the secondary transfer is carried out.

Housing 8 can be drawn out from the apparatus body A, guided by supporting rails 82L and 82R.

In the housing 8, there are arranged the image forming sections 10Y, 10M, 10C, 10K, and the endless-belt shape intermediate transfer unit 7.

The image forming sections 10Y, 10M, 10C, and 10K are disposed vertically in alignment. The endless-belt shape intermediate transfer unit 7 is disposed on the left side, in the figure, of the photoreceptors 1Y, 1M, 1C, and 1K. The endless-belt shape intermediate transfer unit 7 is comprised of the endless-belt shape intermediate transfer member 70 which is circulative and windingly rotated by the rollers 71, 72, 73, and 74, the primary transfer rollers 5Y, 5M, 5C, 5K, and the cleaning device 6A.

Figure 2:
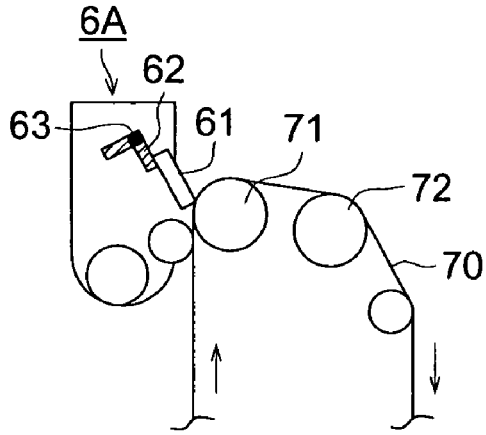
FIG. 2 shows an example of a cleaning device of an intermediate transfer member.

FIG. 2 shows an example of cleaning means of the intermediate transfer member. The cleaning device 6A of the intermediate transfer member is constructed by blade 61 fitted to bracket 62 that is controlled rotatively around supporting shaft 63, as shown in FIG. 2, and the pressing force of the blade applied to the roller 71 can be adjusted by varying a spring load or gravity load.

By drawing the housing 8, the image forming sections 10Y, 10M, 10C, and 10K, and the endless-belt shape intermediate transfer unit 7 can be integratedly drawn out from the body A.

The supporting rail 82L on the left side, in the figure, of the housing 8 is disposed at the left of the endless-belt shape intermediate transfer member 70 and above the fixing device 24. The supporting rail 82R on the right side, in the figure, of the housing 8 is disposed in the vicinity below the developing device 4K at the bottom part. The supporting rail 82R is disposed at a position where the developing device 4Y, 4M, 4C, and 4K are not obstructed from attaching to and detaching from the housing 8.

The right parts, in the figure, of the photoreceptor 1Y, 1M, 1C, and 1K are surrounded by the respective developing devices 4Y, 4M, 4C, and 4K; the bottom parts, in the figure, thereof are surrounded by the respective charging devices 2Y, 2M, 2C, and 2K, and the respective cleaning devices 6Y, 6M, 6C, and 6K; and the left parts, in the figure, thereof are surrounded by the endless-belt shape intermediate transfer member 70.

A combination of a photoreceptor, a cleaning device, charging device, and the like, forms one photoreceptor unit, and a combination of a developing device, a toner supply device, and the like, forms one developing unit.

Figure 3:
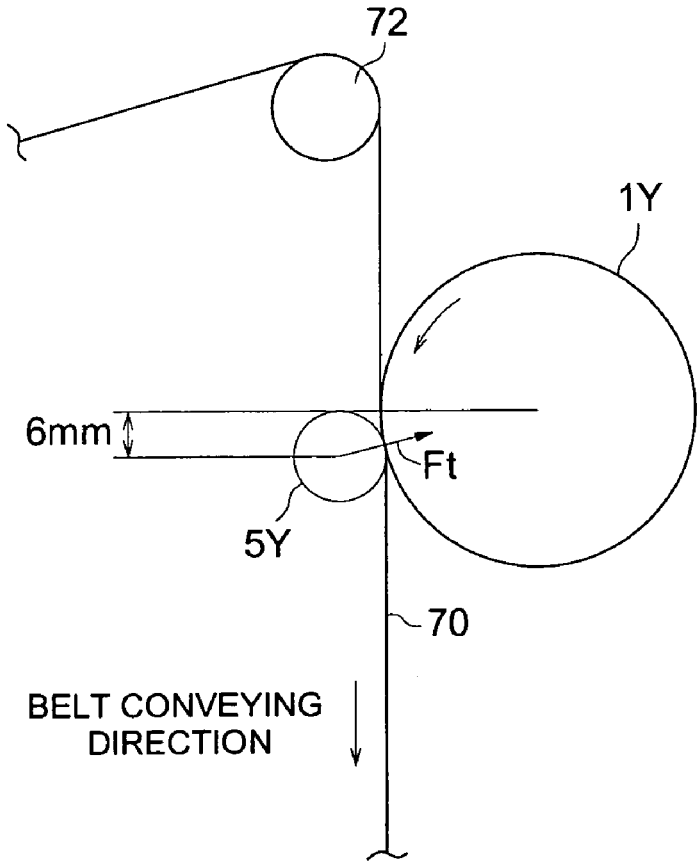
FIG. 3 is an arrangement diagram showing an example of the position relationship between a photoreceptor, an endless-belt shape intermediate transfer member, and a primary transfer roller.

FIG. 3 is an arrangement diagram showing the position relationship between a photoreceptor, the endless-belt shape intermediate transfer member, and a primary transfer roller. The primary transfer roller 5Y, 5M, 5C, and 5K are pressed against the respective photoreceptors 1Y, 1M, 1C, and 1K from the rear side of the endless-belt shape intermediate transfer member 70 as the intermediate transfer member, wherein, as shown in the arrangement diagram of FIG. 3, the primary transfer rollers 5Y, 5M, 5C, and 5K are pressed against the respective photoreceptors 1Y, 1M, 1C, and 1K, at positions downstream, with respect to the direction of the rotation of the photoreceptors, from the respective points of contact between the endless-belt shape intermediate transfer member 70, as the intermediate transfer member, and the photoreceptors 1Y, 1M, 1C, and 1K, at which points the endless-belt shape intermediate transfer member 70 contacts with the respective photoreceptors 1Y, 1M, 1C, and 1K while the primary transfer rollers 5Y, 5M, 5C, and 5K are not pressed against the respective photoreceptors 1Y, 1M, 1C, and 1K. When the primary transfer rollers 5Y, 5M, 5C, and 5K are pressed against the photoreceptors 1Y, 1M, 1C, and 1K, the endless-belt shape intermediate transfer member 70, as an intermediate transfer member, is curved along the respective circumferences of the photoreceptor 1Y, 1M, 1C, and 1K, and the primary transfer rollers 5Y, 5M, 5C, and 5K are disposed at the most downstream side of the respective regions in which the photoreceptors contact with the endless-belt shape intermediate transfer member 70.

Figure 4:
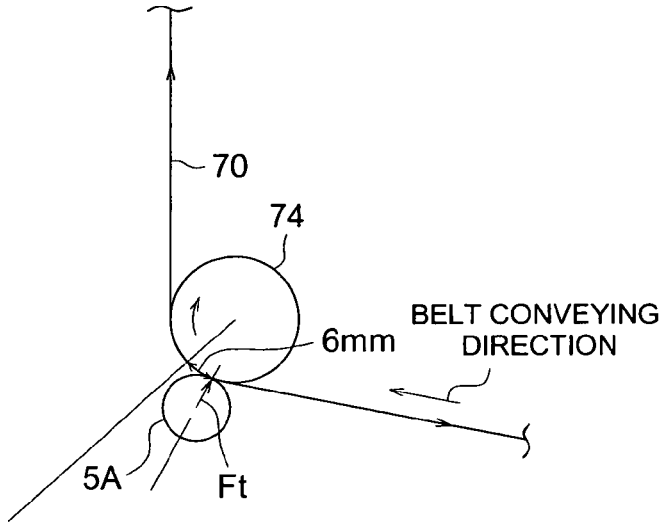
FIG. 4 is an arrangement diagram showing an example of the position relationship between a backup roller, the endless-belt shape intermediate transfer member, and a secondary transfer roller.

FIG. 4 is an arrangement diagram showing the position relationship between a backup roller, the endless-belt shape intermediate transfer member, and the secondary transfer roller. It is desirable, as shown in the arrangement diagram in FIG. 4, that the secondary transfer roller 5A is positioned upstream, with respect to the direction of the rotation of the backup roller 74, from the center of a contact region between the endless-belt shape intermediate transfer member 70, as the intermediate transfer member, and the backup roller 74, in which region the endless-belt shape intermediate transfer member 70 and the backup roller 74 contact with each other while the intermediate transfer member 70 is not pressed by the secondary transfer roller 5A.

The intermediate transfer member is preferably prepared by employing a high molecule film of polyimide, polycarbonate, polyvinylidene fluoride (PVdF) or synthetic rubber such as silicon rubber or fluoride rubber, added with a conductive filler such as carbon black or a conductive resistance adjusting agent so that the volume resistance thereof is adjusted to the range of $1\times10^5$ to $1\times10^{11}$ Ωcm, wherein the intermediate transfer member may be either drum shaped or belt shaped, and preferably belt shaped in view of degree of freedom of designing the apparatus.

The water content ratio of the surface of the intermediate transfer member can be adjusted by selecting a suitable conductive filler or conductive resistance adjusting agent to be mixed with a high molecule film or a synthetic rubber described above. The conductive filler can be, for example, carbon blacks black-lead, aluminium dope zinc oxides stannic oxide can titaniac stannic oxides stannic oxide can barium sulfates potassium titanate, aluminium metal powder, nickel metal powder. The conductive resistance adjusting agent can be, for example, tetraalkylammonium salts trialkyl benzyl ammonium salt, alkylsulfonate salt, alkyl benzene sulfonate, alkylsulphate, glycerine fatty acid ester, sorbitan fatty acid esters polyoxyethylene alkylamine, polyoxyethylene fatty alcohol ester, alkyl betaine, lithium perchlorate. The water content ratio of the surface of the intermediate transfer member can be adjusted by selecting such a conductive filler or conductive resistance adjusting agent.

The water content of the surface of the intermediate transfer member is measured as follows. Components constituting the range from the surface to the depth of 5 μm of the intermediate transfer member are taken in an amount enough for measurement of the water content; the components of the surface layer are placed into a laboratory dish and left standing for 24 hours at 30° C. and RH 80%; and thereafter the water content can be measured with Karl Fischer Moisture Titrator (model MKA-3p manufactured by Kyoto Electronics). The values of water content are sampled at 12 points in the central part of the image transfer section of the intermediate transfer member, and the water content is determined with the average of the measured values.

Figure 6:
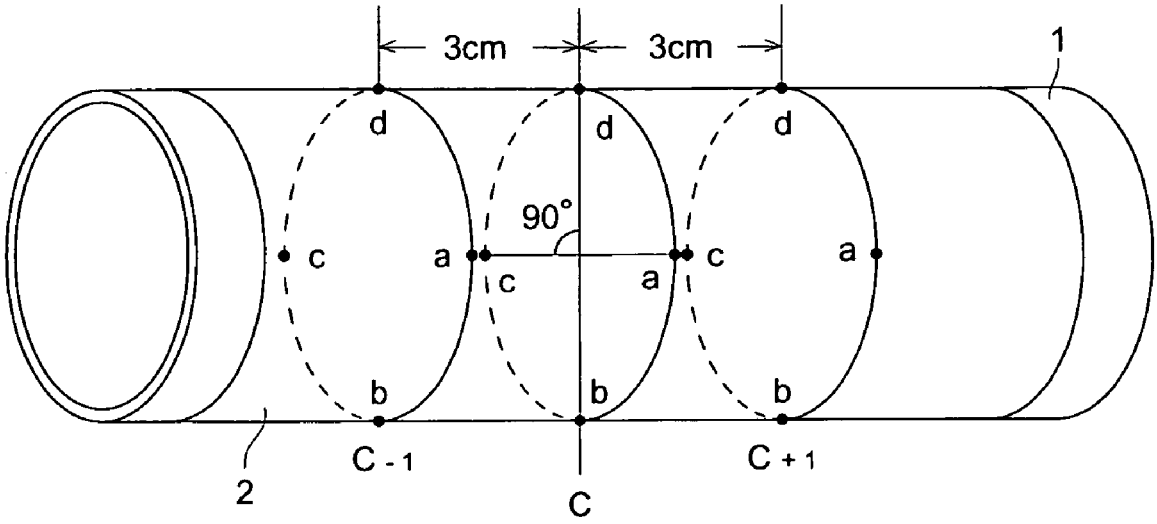
FIG. 6 is a diagram showing measured parts of four points on cross-sections.

The measured parts, explained referring to FIG. 6, are at respective four points on cross-sections at the central position C, position $C_{-1}$, and position $C_{+1}$, of transfer part 2, wherein $C_{-1}$ and $C_{+1}$ are 3 cm distant from C, and the four points on each cross-section are on lines orthogonal to each other. Accordingly, measurement is carried out at 12 points represented by Ca, Cb, Cc, Cd, $C_{+1}$a, $C_{+1}$b, $C_{+1}$c, $C_{+1}$d, $C_{-1}$a, $C_{-1}$b, $C_{-1}$c, and $C_{-1}$d, and the average thereof is denoted by P. In the case that the intermediate transfer member is an endless belt, the belt is stretched at both ends of the length thereof by rollers, for example, from inside, wherein the center of the distance between the rollers is equivalent of the position C in FIG. 6. Incidentally, other measuring devices can be employed as long as the measurement principle is the same.

Preferably, the surface of the intermediate transfer member is suitably made rough. By making ten point surface roughness of the intermediate transfer member in the range from 0.5 to 2 μm, transfer ratio of secondary transfer from the intermediate transfer member to a recording sheet can be easily increased.

The water content ratio of the surface of an electrophotographic photoreceptor is preferably smaller than that of the surface of an intermediate transfer member. As a method of controlling the water content ratio of the surface of a photoreceptor, it is preferably controlled such that a surface energy lowering agent of which water content ratio is controlled is provided on the surface of the photoreceptor, and thus a film of the surface energy lowering agent is formed on the surface of the photoreceptor, thereby controlling the water content ratio of the surface of the photoreceptor. The surface energy lowering agent and an agent supply device for supplying the surface energy lowering agent to the photoreceptor will be described below.

A surface energy lowering agent is a substance that adheres to the surface of a photoreceptor and lowers the surface energy of the photoreceptor, and more specifically, a material that increases the contact angle (contact angle with respect to deionized water) of the surface of the photoreceptor in a degree equal to or greater than 1 degree by adhering to the surface.

As a surface energy lowering agent, fluorinated resin containing fatty oil metal salt or a fluororesin containing fluorine atom can be applied, for example, however, it is not limited to materials of fatty oil metal salt or a fluororesin, and any material can be applied as long as the material increases the contact angle (contact angle with respect to deionized water) of the surface of an electrophotographic photoreceptor in a degree equal to or greater than one degree.

As a surface energy lowering agent to be applied on the surface of a photoreceptor, fatty acid metal salt is most preferable because of extendibility on the surface of a photoreceptor and performance of forming a uniform layer. As for the fatty acid metal salt, saturated or unsaturated fatty acid metal salt having carbon number of 10 or more is preferable. For example, aluminum stearate, stearic acid indium, stearic acid gallium, zinc stearate, lithium stearate, magnesium stearate, sodium stearate, pal thymine acid aluminium, aluminium oleate may be usable. More preferably, metal stearate may be usable.

Among the above fatty acid metal salt, fatty acid metal salt with a particularly high outflow rate measured by a flow tester is highly cleavage and capable of effectively forming a layer of fatty acid metal salt on the surface of a photoreceptor. The outflow rate is preferably in the range from $1\times10^{-7}$ to $1\times10^{-1}$ (ml/sec), and most preferably from $5\times10^{-4}$ to $1\times10^{-2}$. The outflow rate was measured employing Shimadzu Flowtester "CFT-500" (manufactured by Shimadzu Corporation).

For fluorinated resin of the surface energy lowering agent, polyvinylidene fluoride, polytetrafluoroethylene are preferable.

Measurement of the water content ratio of the surface energy lowering agent can be performed after leaving the material for 24 hours at a temperature of 30° C. and RH 80% with Karl Fischer Moisture Titrator (model MKA-3p manufactured by Kyoto Electronics) into a laboratory dish. Incidentally, other measuring devices can be employed as long as the measurement principle is the same.

Adjustment of the water content ratio of the surface energy lowering agent can be achieved by control of hydrophilic components and impurities in the material such as refining, hydrophobic processing, and decreasing of water content amount under a high temperature and humidity (30° C. and RH 80%) as well as mixing of water content adjusting agent, high temperature drying, and the like. With a large amount of the water content, it is difficult to uniformly extend the surface energy lowering agent on the surface of the photoreceptor, and the effects of the invention cannot be realized sufficiently. The water content ratio is preferably not greater than 5.0 wt %, and further preferably in the range from 0.05 to 3.0 wt %. On the other hand, if the water content ratio is smaller than 0.05 wt %, the effects of the invention are affected by an environmental change due to temperature rise or the like during copying, particularly by humidity at the place of the image carrier, and selection of material and hydrophobic treatment are difficult. If the water content ratio is greater than 5.0 wt %, hollow defects and character blurring easily occur.

The agent supply device for supplying the surface energy lowering agent can be installed at any suitable position around the photoreceptor, however, to utilize a installation space, the agent supply device may be installed making use of a part of the charging device, developing device, or the cleaning device illustrated in FIG. 1. In the following, an example of using the cleaning device also as the agent supply device will be described. The shape of the surface energy lowering agent is not particularly limited, however, it is preferable that the surface energy agent is formed as a solid material, and changed into a plate shape or a bar shape as necessary to be used.

Figure 5:
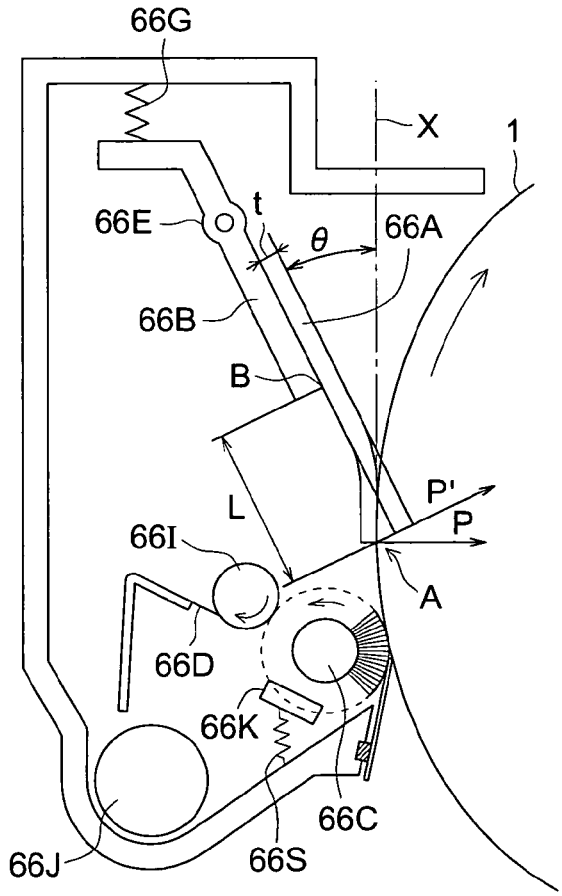
FIG. 5 is a construction diagram of an example of the cleaning device installed at the photoreceptor.

FIG. 5 is a construction diagram of an example of a cleaning device installed at a photoreceptor in the invention. This cleaning device is used as a cleaning device of 6Y, 6M, 6C, 6K, and the like, in FIG. 1. Cleaning blade 66A in FIG. 5 is fitted to supporting member 66B. As the material of the cleaning blade, a rubber elastic body is employed. Specifically, for the material, there are known urethane rubber, silicone rubber, fluorine-containing rubber, chloropyrene caoutchouc, butadiene rubber, wherein urethane rubber is particularly preferable because of excellent friction characteristic compared with other rubbers.

Supporting member 66B is constructed by a plate shape metal material or plastic material. As a metal material, a stainless steel plate, aluminum plate, or an earthquake resistant steel plate is preferable.

The tip of the cleaning blade that is pressed against the surface of the photoreceptor in contact therewith is preferably pressed in the state that a load is applied in the direction (counter direction) opposite to the rotation of the photoreceptor. As shown in FIG. 5, the tip of the cleaning blade preferably forms a pressure contact plane when it contacts with the photoreceptor with pressure.

Preferable values of contact load P and contact angle θ are respectively P=5 to 40 N/m and θ=5 to 35 degrees.

The contact load P is a vector value, in the normal direction, of press load P' during when cleaning blade 66A is in press contact with photoreceptor drum 1.

The contact angle θ is an angle between tangent X of the photoreceptor at contact point A and the blade (shown by a dotted line) having not yet been displaced. Numeral 66E represents a rotation shaft that allows the supporting member to rotate, and 66G represents a load spring.

Free length L of the cleaning blade represents, as shown in FIG. 5, the distance between the position of edge B of the supporting member 66B and the tip point of the blade having not yet been displaced. A preferable value of the free length L is in the range from 6 to 15 mm. Thickness t of the cleaning blade is preferably in the range from 0.5 to 10 mm. The thickness of the cleaning blade herein is in the octagonal direction with respect to a surface adhering to the supporting member 66B.

Brush roll 66C is employed as the cleaning device in FIG. 5 which also serves as the agent supply device. The brush roll has functions of removing toner adhering to the photoreceptor 1 and recovering the toner removed by the cleaning blade 66A as well as a function as an agent supply device for supply of surface energy lowering agent to the photoreceptor. That is, the brush roll contacts with the photoreceptor 1, rotates in the same direction with the rotation of the photoreceptor at a contact part thereof, removes toner and paper particles on the photoreceptor, conveys toner removed by the cleaning blade 66A, and recovers the removed toner and paper particles to conveying screw 66J. Regarding the path herein, it is preferable that flicker 66I as removing means is contacted with the brush roll 66C, thereby removing the removed such as the toner which has been transferred from the photoreceptor 1 to the brush roll 66C. Further, the toner deposited to the flicker is removed by scraper 66D and recovered into the conveying screw 66J. The recovered toner is taken out outside as waste, or conveyed to a developing vessel through a recycle pipe (not shown) for recycling toner to be reused. As a material of the flicker 66I, metal pipes of stainless steel, aluminum, etc. are preferably used. As the scraper 66D, it is preferable that an elastic plate such as phosphor-bronze plate, polyethylene terephthalate board, polycarbonate plate is employed, and the tip thereof is contacted with the flicker by a counter method in which the tip forms an acute angle with respect to the rotation direction of the flicker.

Surface energy lowering agent (solid material of zinc stearate) 66K is pressed by spring load 66S to be fitted to the brush roll, and the brush rubs the surface energy lowering agent while rotating to supply the surface energy lowering agent to the surface of the photoreceptor.

As the brush roll 66C, a conductive or semiconductive brush roll is employed.

An arbitrary material can be used as the material of the brush of the brash roll, however, a fiber forming high molecular polymer having a high dielectric constant is preferable. As such a high molecular polymer, for example, rayon, nylon, polycarbonate, polyester, a methacrylic acid resin, acryl resin, polyvinylchloride, polyvinylidene chloride, polypropylene, polystyrene, polyvinyl acetate, styrene-butadiene copolymer, vinylidene chloride-acrylonitrile copolymer, chloroethylene-acetic acid vinyl copolymer, chloroethylene-vinyl acetate-maleic anhydride copolymer, silicone resin, silicone-alkyd resin, phenol-formaldehyde resin, styrene-alkyd resin, polyvinylacetal (for example, polyvinylbutyral) may be usable. These high molecular polymers can be used solely or in a mixture of each other in two or more high molecular polymers. Preferably, rayon, nylon, polyester, acryl resin, polypropylene may be usable.

As the brush, a conductive or semiconductive brush is employed, wherein the brush is prepared by providing a low resistance material such as carbon into a material of the brush and adjusting the specific resistance of the material of the brush to an arbitrary value.

The specific resistance of a brush bristle of the brush roll is preferably in the range from $10^1$ to $10^6$ Ωcm when measured in the state that a voltage of 500 volts is applied to both ends of a piece of brush bristle with a length of 10 cm at a normal temperature and humidity (temperature 26° C., humidity 50%).

The brush roll is preferably comprised of a stem of stainless steel or the like and conductive or semiconductive brush bristles having a specific resistance in the range from $10^1$ to $10^6$ Ωcm. If the specific resistance is lower than $10^1$ Ωcm, banding or the like due to electric discharge easily occurs. If the specific resistance is higher than $10^6$ Ωcm, the electrical potential difference from the photoreceptor is low, and cleaning defects easily occur.

A brush bristle for the brush roll preferably has a thickness in the range from 5 to 20 denier. If the thickness of each brush bristle is smaller than 5 denier, the brush roll cannot remove surface deposits due to an insufficient rubbing force. If the thickness of each brush bristle is larger than 20 denier, the brush scratches the surface of the photoreceptor due to stiffness and promotes abrasion, thus shortening the life of the photoreceptor.

The value in "denier" herein is the value of mass of a 9000 m long brush bristle (fiber) measured in grams, the brush bristle constructing the brush.

The density of the brush bristles of the brush is in the range from $4.5\times10^2/cm^2$ to $2.0\times10^4/cm^2$ (number of brush bristles per $cm^2$). If the density is smaller than $4.5\times10^2/cm^2$, the rubbing force is weak due to low stiffness of the bristles, and irregularities are caused in rubbing, which makes it difficult to remove deposits uniformly. If the density is larger than $2.0\times10^4/cm^2$, the photoreceptor is abraded easily by a strong rubbing force due to high stiffness of the bristles, which makes it easy to cause image defects such as fogging due to drop in sensitivity and black streaks due to scratches.

The depth of piercing of the brush roll into the photoreceptor is preferably set within the range 0.4 to 1.5 mm. This depth of piercing is equivalent to the load caused by a relative motion between the drum of the photoreceptor and the brush roll and applied to the brush. This load corresponds to a rubbing force applied by the brush to the drum of the photoreceptor from the viewpoint thereof. Therefore, it is necessary to specify the range of the load so that the photoreceptor is rubbed with a proper force.

This depth of piercing is defined by a length of piercing into the photoreceptor with an assumption that a brush bristle goes linearly inside the photoreceptor without curving on the surface of the photoreceptor when the brush contacts with the photoreceptor.

By setting the piercing depth equal to or longer than 0.4 mm, the rubbing force of the brush to be applied to the drum of the photoreceptor is tuned properly, thereby filming of toner, paper particles, and the like onto the surface of the photoreceptor is inhibited, and irregularities on the image are suitably inhibited. By setting the piercing depth equal to or shorter than 1.5 mm, the rubbing force of the brush to be applied to the drum of the photoreceptor is tuned properly, thereby the abrasion amount of the photoreceptor is reduced, fogging due to drop in sensitivity is prevented, and scratches on the surface of the photoreceptor and streaking defects on the image are avoided.

As the stem of a roll part to be used as a brush roll, metals such as stainless steel and aluminum, paper, plastics are mostly used, but not limited to these.

Preferably, the brush roll is provided with a brush through a sticking layer on the surface of a cylindrical stem.

The brush roll preferably rotates such that a contact part thereof moves in the same direction as that of the motion of the surface of the photoreceptor. If the contact part moves in the opposite direction, and there is excessive toner on the surface of the photoreceptor, toner removed by the brush roll may spill out and dirty the recording sheet and the apparatus.

In the motion of the photoreceptor and the brush roll in the same direction as described above, the surface velocity ratio between them is preferably in the range from 1:1 to 1:2. If the rotation speed of the brush roll is smaller than that of the photoreceptor, the toner removal performance of the brush roll is reduced, thus cleaning defects easily occur, and if the rotation speed of the brush roll is greater than that of the photoreceptor, the toner removal performance is excessive to cause blade bounding or curving.

The photoreceptor preferably contains particles on the surface thereof. It is preferable that ten point surface roughness of the photoreceptor Rz is set within the range of 0.05 to 4.0 μm by providing the particles. By setting the ten point surface roughness of the photoreceptor within the above range, the surface energy lowering agent is supplied onto the surface of the photoreceptor by the agent supply device uniformly, and extended on the surface of the photoreceptor uniformly to form a layer, which allows the surface energy of the photoreceptor to decrease uniformly so that occurrence of hollow defects and character blurring, and degradation of sharpness are prevented.

Ten point surface roughness of the photoreceptor Rz (Definition and Measuring method of ten point surface roughness Rz)

Rz means a value for a reference length of 0.25 mm described in JISB0601-1982. That is the difference between the average height of the highest five peaks and the average depth of the lowest five valleys between a distance of the reference length 0.25 mm.

In an embodiment described later, ten point surface roughness Rz was measured with a surface roughness meter (Surfcorder SE-30H manufactured by Kosaka Laboratory Ltd.). However, any other measuring device can be employed as long as it obtains the same result within an error range.

Adjustment of the ten point surface roughness Rz of the photoreceptor to be in the range of 0.05 to 4.0 μm can be achieved by adjusting the surface roughness of a support that constructs the photoreceptor and the surface roughness of the surface layer of the photoreceptor. Particularly, the surface roughness can be effectively adjusted by providing a layer constructing the surface layer of the photoreceptor with various kinds of particles.

Ten point surface roughness Rz of the photoreceptor can be effectively controlled to be within the range of 0.05 to 4.0 μm by giving roughness to the surface of the conductive support that constructs the photoreceptor to a proper degree.

Ten point surface roughness Rz of the conductive support is preferably greater than 0.1 μm and not greater than 6.0 μm, and more preferably within the range from 0.2 μm to 5.0 μm. The roughness of the surface of the photoreceptor can be adjusted by coating an intermediate layer and a photoreceiving layer, described later, on the support having such a surface roughness.

The surface of the support can be made rough by cutting the surface of the support with a cutting tool or the like, sandblasting in which micro particles are collided with the surface of the support, processing with an ice particle cleaning device disclosed in TOKKAI No. H04-204538, or honing processing disclosed in TOKKAI No. H09-236937. Further, the surface of the support can be made rough by anodic oxidation method, alumite treatment, buffing processing, laser abrasion method described in TOKKAI No. H04-233546, a method using an abrasive tape described in TOKKAI No. H08-1502, or roller burnishing described in TOKKAI NO. H08-1510, or the like. However, methods for making the surface of the support rough are not limited to these.

As another method of making the surface of the photoreceptor rough, there is also a method providing particles with a number average particle diameter within a range of 0.05 to 8 μm into a surface part of the photoreceptor, wherein the surface part is a part from the surface of the photoreceptor to a depth of 5 μm, and it is sufficient if a part of the particles are held by the surface part. Regarding particles to be provided, it is possible to adjust ten point surface roughness of the photoreceptor to be within the above range by dispersely providing the surface layer of the photoreceptor with inorganic micro particles having been subjected to hydrophobic treatment as described in TOKKAI No. H08-248663, for example. Inorganic particles can be made hydrophobic by employing a method using a hydrophobic treatment agent such as titanate coupling agent, silane coupling agent, high molecule fatty acid or metal salt of high molecule fatty acid.

As organic particles for the above described particles, particles of polyacrylics, polymethacrylate, polymethyl methacrylate, polyethylene, polypropylene, polyvinylidene fluoride may be applied.

As inorganic particles, particles such as silica, titanic oxide, alumina, barium titanate, calcium titanate, strontium titanate, zinc oxide, magnesium oxide, zirconia, barium sulfate, barium carbonate, calcium carbonate, silicon carbide, silicon nitride, chromium oxide, red ocher can be applied.

The inorganic particles described above are preferably subjected to hydrophobic processing. This hydrophobic processing can be performed by reacting inorganic particles with hydrophobic treatment agent at a high temperature. The hydrophobic treatment agent is not particularly limited, and for example, silane coupling agent such as hexamethyldisilazane, dimethyldichlorosilane, decyl silane, dialkyl dihalogen silane, trialkyl halogenated silane, and alkyl trihalogenated silane or dimethyl silicone oil may be usable. The amount of the hydrophobic treatment agent depends on the kind of the particles and the like, and cannot necessarily be specified, but usually, the greater the amount, the higher the hydrophobic degree. Further, it is effective that hygroscopic substances are removed by reprecipitation, heat treatment, or the like.

The number average particle diameter of micro particles and the like is preferably in the range of 5 nm to 8 μm, and further preferably 10 nm to 6 μm. Incidentally, the number average particle diameter is obtained in such a way that: the particles are magnified 2000 times by observation with a transfer type electronic microscope; particles in a quantity of 100 are observed at random as primary particles; and thus, a measured value is determined by image analysis as an average diameter in Feret direction.

The relationship between the water content ratio of the surface of the photoreceptor (Wa) and the water content ratio of the surface of the intermediate transfer member (Wb) is preferably Wa<Wb, and more preferably satisfies the following expression.

$$Wa<Wb<5.0 \text{ (wt \%)}$$

If Wa and Wb have the above relationship, it is easier to remarkably improve image defects such as hollow defects and character blurring. The water content ratio of the photoreceptor herein can be measured in the same way as the measurement of the water content ratio of the intermediate transfer member.

Further, if the relationship between the contact angle (A) for water on the surface of the photoreceptor and the contact angle (B) for water on the surface of the intermediate transfer member is A<B, the effects of the invention are further improved.

Measurement of contact angle

The contact angle of the surface of the photoreceptor and the intermediate transfer member are measured with respect to deionized water with a contact angle meter (model CA-DT.A manufactured by Kyowa Interface Science Co., Ltd.) in an environment of 30° C. and RH 80%. The measurement device here is not particularly limited as long as the measurement principle is the same.

Next, a photoreceptor will be described.

A photoreceptor is an electrophotographic photoreceptor to be used for electrophotographic image forming, and particularly, the effects of the invention are remarkably apparent when organic electrophotographic photoreceptors (organic photoreceptor) are employed. Organic photoreceptors are electrophotographic photoreceptors that are provided, in an organic compound thereof, with at least one of a charge generating function and a charge transporting function, which is essential for an electrophotographic photoreceptor, and include photoreceptors made of a known organic charge generating material or organic charge transporting material, photoreceptors made of a high molecular complex with a charge generating function and a charge transporting function, and all other known organic electrophotographic photoreceptors.

The configuration of an organic photoreceptor will be described below.

Conductive Support

As a conductive support to be used in a photoreceptor may have either a sheet shape or a cylindrical shape, wherein cylindrical conductive support is preferable for designing an image forming apparatus in a small size.

An cylindrical conductive support is a cylindrical support which is necessary for endless forming of images with rotation, and is preferably a conductive support having a circularity not greater than 0.1 mm and a run-out not greater than 0.1 mm. If the circularity or the run-out exceeds this range, it is difficult to achieve satisfactory image forming.

As a material of the conductive support to be used in a receptor, there are given metals such as aluminum, nickel, copper, brass, steel, stainless steel, and the like; plastic drums evaporated with aluminum, tin oxide, indium oxide, and the like; paper/plastic drums coated with a conductive material, and other plastic materials, being formed into a belt or drum shape. In a conductive support, the specific resistance is preferably equal to or smaller than $10^3$ Ωcm at a normal temperature. Particularly, aluminum is preferably employed because of advantages in cost and manufacturability, and in usual cases, extrusion formed or drawing formed aluminum base pipes in a thin cylinder shape are widely used.

Intermediate Layer

In the invention, it is also possible to provide an intermediate layer having a function of improving the adhesibility to the photosensitive layer and a function as an electrical barrier, between the conductive support and the photoreceptive layer. The layer thickness of an intermediate layer using a curable metal resin is preferably in the range of 0.1 to 5 μm.

Photoreceptive Layer

The photoreceptive layer of a photoreceptor may have a mono-layer structure having a charge generating function and a charge transporting function in a single layer which is disposed on the intermediate layer. However, it is more preferable that the photoreceptive layer has a structure in which the functions thereof are separately provided in a charge generating layer (CGL) and a charge transporting layer (CTL) thereof. With a structure of a photoreceptor having functions in separate layers, increase in residual electric potential due to repeated use can be controlled to be small, and other electric photographic characteristics can be easily controlled to suit purposes. A photoreceptor for negative charging preferably has a structure with a charge generating layer (CGL) disposed on an intermediate layer and a charge transporting layer (CTL) on the CGL. In the case of a photoreceptor for positive charging, the order of CGL and CTL is reversed from that in the case of a photoreceptor for negative charging. The most preferable structure of a photoreceptor is that of a photoreceptor for negative charging, in which functions are provided in separate layers, as described above.

Preparation of a photoreceptive layer of a photoreceptor for negative charging with functions in separate layers will be described below.

Charge Generating Layer

A charge generating layer contains a charge generating material (CGM). In addition, the charge generating layer may contain a binder resin and other additives as necessary.

As the charge generating material (CGM), a known charge generating material (CGM) can be used. For example, phthalocyanine pigment, azo pigment, a perylene pigment, an asrhenium pigment can be applied. Among these, CGMs which can minimize increase in residual electrical potential due to repeated use have a cubic electric potential structure which allows a stable cohesive structure between a plurality of molecules, and are concretely CGMs such as phthalocyanine pigment and perylene pigment having a special crystal structure. For example, CGMs such as titanylphthalocyanine having a maximum peak of Bragg angle 2θ for Cu—Kα radiation at 27.2 degrees and benzimidazole perylene having a maximum peak of the same at 12.4 degrees, do not degrade with repeated use and can reduce increase in residual electric potential.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.01 to 2 μm.

Charge Transporting Layer

A charge transporting layer contains a charge transporting material (CTM) and a binder resin for dispersing the CTM and forming a layer. In addition, the charge transporting layer may contain additives such as an antioxidant agent as necessary.

As a charge transporting material (CTM), a known charge transporting material (CTM) can be used. For example, triphenylamines, hydrazones, styryl compound, benzidine compound, butadiene compound can be applied. These charge transporting materials are usually dissolved in a proper binder resin to form a layer. Among these, CTMs which can minimize increase in residual electric potential due to repeated use have a high mobility and a characteristic that the ionization potential difference from that of a CGM to be combined is not greater than 0.5 eV, and preferably not greater than 0.25 eV.

An ionization potential of CGM and CTM can be measured with a surface analysis apparatus AC-1 (a product made in Riken Keiki company).

As a resin used for the charge transporting layer (CTL), for example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable.

Further, other than these insulation-related resin, high polymer organic semiconductor such as poly-N-vinyl carbazole may be usable. The most preferred material is polycarbonate resin as a binder of these CTLs. Further it is preferable that film thickness of the charge transporting layer is 10–40 μm.

Protective Layer

As a protective layer of photoreceptor, various kinds of resin layer can be provided.

In particular, by providing a cross linking type resin layer, an organic photoreceptor of the present invention having strong machinery strength can be obtained.

EXAMPLE

Hereinafter, the present invention is explained in detail by showing examples, but aspects of the invention are not limited to these examples. Incidentally, "part" in the following sentences represents "parts by weight".

Manufacture of Photoreceptor

Manufacture of Photoreceptor 1

The following dispersions were prepared and coated on a cylindrical aluminum base substance obtained by a drawing process, thereby an electrically conductive layer having a dry film thickness of 15 μm was formed.

| <Electrically conductive layer (PCL) composition liquid> | |
|---|---|
| phenol resin | 160 parts |
| conductive titania pigment | 200 parts |
| methyl cellosolve | 100 parts |

The following intermediate layer composition liquid was prepared. This composition liquid was coated by a dip coating method (immersion coating method) on the conductive layer, thereby an intermediate layer having a film thickness of 1.0 μm was formed.

| <Intermediate layer (UCL) composition liquid> | |
|---|---|
| polyamide resin (Amilan CM-8000: product made in Toray company) | 60 parts |
| methanol | 1600 parts |
| 1-butanol | 400 parts |

The following coating composition liquids were mixed and dispersed by means of sand mill for ten hours, thereby electric charge generating layer coating liquid was prepared. This coating liquid was coated by a dip coating method on the intermediate layer, thereby an electric charge generating layer of dry film thickness 0.2 μm was formed.

| <Electric charge generating layer (CGL) composition liquid> | |
|---|---|
| oxytitanylphthalocyanine pigment (having the maximum peak angle of X-ray diffraction by Cu—Kα characteristic X-ray at an angle 2θ of 27.3°) | 60 parts |
| silicone resin solution (KR5240, 15% xylene - butanol solution: produced by Shinetsu chemistry company) | 700 parts |
| 2-butanone | 2000 parts |

The following coating composition liquids were mixed and dissolved, thereby an electric charge transporting layer coating liquid was prepared. This coating liquid was coated by a dip coating method on the electric charge generating layer, thereby a charge transporting layer having a dry film thickness of 20 μm was formed and a photoreceptor 1 was produced. Rz of the photoreceptor was 0.21 μm, and a contact angle for a pure water was 85°.

| <Charge transporting layer (CTL) composition liquid> | |
|---|---|
| charge transport material (N-(4-methylphenyl)-N-{4-(β-phenyl styryl) phenyl}-p-toluidine) | 200 parts |
| bisphenol Z type polycarbonate (Eupilon Z300: products refined once with methanol and produced by Mitsubishi Gas Chemical company) | 300 parts |
| 1,2-dichloroethane | 2000 parts |
| silica (average particle diameter 0.2 μm, silicone oil treatment) | 30 parts |

Manufacture of Photoreceptor 2

The following intermediate layer composition liquid was coated by a dip coating method on a cylindrical aluminum base substance which was machined by a cutting process with a cutting tool so as to have a ten point surface roughness Rz of 0.1 μm, and dried for 30 minutes under a temperature of 150° C., thereby an intermediate layer having a thickness of 1.0 μm was formed.

| <Intermediate layer (UCL) composition liquid> | |
|---|---|
| zirconium chelate compound ZC-540 (Matsumoto pharmaceutical Co., Ltd.) | 200 parts |
| silane coupling agent KBM-903 (Shinetsu chemistry Co., Ltd.) | 100 parts |
| methanol | 700 parts |
| ethanol | 300 parts |

The following coating composition liquids were mixed and dispersed by means of sand mill for ten hours, thereby an electric charge generating layer coating liquid was prepared. This coating liquid was coated by a dip coating method on the intermediate layer, thereby an electric charge generating layer having a dry film thickness of 0.2 μm was formed.

| <Electric charge generating layer (CGL) composition liquid> | |
|---|---|
| oxytitanylphthalocyanine pigment (having the maximum peak angle of X-ray diffraction by Cu-Kα characteristic X-ray at an angle 2θ of 27.3°) | 60 parts |
| a silicone resin solution (KR5240, 15% xylene - butanol solution: product made by Shinetsu chemistry company) | 700 parts |
| 2-butanone | 2000 parts |

The following coating composition liquids were mixed and dissolved, thereby an electric charge transporting layer coating liquid was prepared. This coating liquid was coated by a dip coating method on the electric charge generating layer, thereby the charge transporting layer having a film thickness of 20 μm was formed and photoreceptor 2 was produced. Rz of the photoreceptor was 1.3 μm, and the contact angle for a pure water was 81°.

| <Charge transporting layer (CTL) composition liquid> | |
|---|---|
| charge transport material (N-(4-methylphenyl)-N-{4-((β-phenyl styryl) phenyl}-p-toluidine) | 200 parts |
| bisphenol Z type polycarbonate (Eupilon Z300: products refined three times with methanol and produced by Mitsubishi Gas Chemical company) | 300 parts |
| 1,2-dichloroethane (refined product) | 2000 parts |
| silica (average particle diameter 2.1 μm, silicone oil treatment) | 30 parts |

Intermediate Transfer Member

As the intermediate transfer member, an intermediate transfer-member having the following water content was used.

Intermediate Transfer Member 1

A semi-conductive belt-shaped base substance in which conductive carbon black (particle diameter 20 μm, specific surface area 200 $m^2/g$) was dispersed in an ethylene −4 ethylene fluoride copolymer resin was used. The volume resistance ratio was $1.2\times10^9$ Ω·cm, and the surface water content was 0.5%.

Intermediate Transfer Member 2

An aromatic polyamide acid solution obtained by conducting polycondensation reaction for aromatic polyimide which was obtained from 3,3',4,4'-benzophenone tetracarboxylic acid 2 anhydride and 3,3'-diamino benzophenone and conductive carbon black (particle diameter 17 μm, specific surface area 300 $m^2/g$) were mixed and dispersed, and subsequently were subjected to a shaping process by a shaping device, thereby an aromatic polyimide film was obtained, and further a heating process was conducted for the aromatic polyimide film. The bulk resistance value was $6.7\times10^9$ Ω·cm and the surface water content was 0.6%.

Intermediate Transfer Member 3

A semi-conductive belt-shaped base substance in which conductive carbon black (particle diameter of 25 μm, specific surface area of 180 $m^2/g$) was dispersed in a polycarbonate resin was used. The volume resistance ratio was $4.7\times10^8$Ω·cm, and the surface water content was 1.1%.

Intermediate Transfer Member 4

A semi-conductive belt base substance in which conductive carbon black (particle diameter of 25 μm, specific surface area of 180 $m^2/g$) was dispersed in 6/66 nylon system copolymer was used. The volume resistance ratio was $5.2\times10^8$ Ω·cm, and the surface water content was 3.0%.

Intermediate Transfer Member 5

A conductive carbon black (particle diameter of 25 μm, specific surface area of 180 $m^2/g$) was mixed and dispersed in a urethane rubber, and at the outside of a semi-conductive rubber belt base substance having a thickness of 1.0 mm, a fluororesin coating with a thickness of 50 μm was applied. The volume resistance ratio was $1\times10^{10}$ Ω·cm, and the surface water content was 0.05%.

Intermediate Transfer Member 6

A semi-conductive belt base substance in which conductive carbon black (particle diameter of 25 μm, specific surface area of 180 $m^2/g$) was dispersed in diacetate polymer, was used. The volume resistance ratio was $5.2\times10^8$ Ω·cm, and the surface water content was 5.2%.

Manufacture of Surface Energy Lowering Agent A–E

A sodium stearate is dissolved in water, thereby 15 wt % liquid was produced. Further, zinc sulfate was dissolved in water, thereby 25 wt % liquid was produced. A receiving container having a volume of 2 liters with a stirring apparatus including a turbine blade having a diameter of 6cm was prepared, and turbine blade was rotated in 350 rpm. A sodium stearate liquid is put into this receiving container, and the solution temperature was adjusted to 80° C. Next, zinc sulfate liquid which was heated to 80° C. was dropped into this receiving container over 30 minutes. An equivalence ratio of sodium stearate to zinc sulfate was made 0.98, the sodium stearate and the zinc sulfate were mixed such that the quantity of metallic soap slurry became 500 g. After the preparation for the total amount was completed, it was matured for 10 minutes under a temperature condition at the time of reaction, and then the reaction was completed. Next, the metallic soap slurry obtained in this way was twice washed with water, successively, it was washed by means of water. The thus obtained metallic soap cake was dried under a drying temperature of 110° C. A heating and pressing process with a pressure of 100 $kg/cm^2$ was conducted, thereby making it solid. Thereafter, It was left under an environmental condition of a temperature of 30° C. and a humidity of 80% RH for 24 hours. A solid material (surface energy lowering agents A–E) of zinc stearate whose water content was changed as shown in table 1, were obtained. The water contents of A-E were adjusted by changing a drying time under a temperature of 110° C.

Manufacture of Surface Energy Lowering Agent F

A heating and pressing process with a temperature of 80° C. and a pressure of 200 $kg/cm^2$ were conducted for fine grains of commercial Teflon (R), thereby a solid material was obtained. The solid material was left under an environmental condition of a temperature of 30° C. and a humidity of 80% RH for 24 hours, thereby Teflon (R) solid material (surface energy lowering agent F) having the water content of 0.8 wt % was obtained.

TABLE 1

| A kind of surface energy lowering agent | Material (water content: weight %) |
|---|---|
| A | zinc stearate (0.1) |
| B | zinc stearate (1.0) |
| C | zinc stearate (2.5) |
| D | zinc stearate (4.5) |
| E | zinc stearate (5.5) |
| F | Teflon (0.8) |

<Evaluation>

A cleaning means shown in FIG. 5 was mounted as a cleaning means for a photoreceptor of a digital color printer having an intermediate transfer member of FIG. 1, a kind of a photoreceptor, a kind of surface energy lowering agent supplied to the photoreceptor, and a kind of an intermediate transfer member was combined in the digital color printer as shown in combinations in table 2. An image of pixel rate 8% was printed on 100000 sheets of A4 size paper continuously under a high-temperature of 30° C. and a high humidity of 80% RH by the printer, and the printed sheets were evaluated. Evaluation items are evaluations for the lacking of partial toner image and the scattering of character image, a cleaning-ability evaluation, and an image quality evaluation. Evaluation items and criterion for evaluation are shown below. Further, evaluation results are shown in table 2.

Evaluation Item and Criterion for Evaluation

Measurement of Contact Angle of a Photoreceptor

After 100000 sheets of print were evaluated, the contact angle of a photoreceptor surface for a pure water was measured with a contact angle measuring instrument (CA-DT•A type: product made by Kyowa surface science company) under an environment of a temperature of 30° C. and a humidity of 80% RH.

"Occurrence of the Lacking of Partial Toner Image"

A character image was magnified and observed, and presence or absence of occurrence of the lacking of partial toner image was observed by visual observation.

Criterion for Evaluation was as Follows:

A: Until 100000 sheets of prints were completed, occurrence of remarkable lacking of partial toner image was not observed.

B: Until 50000 sheets of prints were completed, occurrence of remarkable lacking of partial toner image was not observed.

C: On a print of less than 50000 sheets, occurrence of remarkable lacking of partial toner image was observed.

"Evaluation of the Scattering of Character Image"

Instead of dot images constructing a character, a 10% halftone image was formed on the entire image surface, and the scattering of toner image around the dot was observed with a magnifying lens.

Rank A: Until 100000 sheets of print were completed, there was a little scattering of toner image.

Rank B: Until 50000 sheets of print were completed, there was a little scattering of toner image.

Rank C: On a print of less than 50000 sheets, scattering of toner image increased Cleaning Ability Evaluation Presence or absence of the occurrence of passing-through of a toner due to abrasion between a photoreceptor and a cleaning blade, and presence or absence of a rolled-up of blade (the phenomenon that a blade turns over or rolls up) were evaluated.

A: There was no occurrence of passing-through of a toner and rolled up of a blade, until 100000 sheets of print were completed.

B: Until 50000 sheets of print were completed, there was no occurrence of passing-through of a toner and rolled up of a blade, C: On a print of less than 50000 sheets, there was an occurrence of passing-through of a toner or an occurrence of turned up of a blade.

Image Quality Evaluation

Image quality was evaluated whether or not the sufficient image density was obtained for each color, or was evaluated mainly on the sharpness of an image (whether an image is clear or blur).

Image density (it was measured using RD-918 made by Macbeth company with a relative reflection density in which a reflection density on a paper is made 0)

A: All of Y, M, C, and K (black) were more than 1.2

B: All of Y, M, C, and K were more than 0.8

C: At least one of Y, M, C, and K was less than 0.8

Sharpness of Image

Under an environment of a high-temperature and an a normal humidity (a temperature of 33° C., a relative humidity of 50%), an image of a thin line was printed, reproducibility and sharpness of the thin line image were evaluated based on character collapse of the thin line image.

Character images of 3 points and 5 points were formed, the character images were evaluated with the following judgment criteria.

A: Both of the 3 point and 5 point character images were clear, and readable easily.

B: The 3 point character image was partially not readable, and the 5 point character image was clear and readable easily.

C: The 3 point character image was almost not readable, and the 5 point character image was partially not readable or almost not readable.

Other Conditions for Evaluation

Line Speed L/S of Image Formation:180 mm/s

An electrostatic charge condition of photoreceptor (60 mm diameter): electro potential of non-image section was detected with a potential sensor, and a feed back control was conducted in such a manner that a control range was −500V to −900V and the surface potential of the photoreceptor was controlled within a range of −50 to 0 V when an entire exposure was conducted.

Imagewise Exposure Light: Semiconductor Laser (Wavelength:780 nm)

Development condition: A developer of each of Y, M, C, K, is a two component developer composed of a toner having a number average particle diameter of 7.5 μm and carrier, and a development apparatus is a type corresponding to the two component developer.

Intermediate transfer member: A seamless endless belt-shaped intermediate transfer member 70 was used, and the belt was made of a semi conductive resin having a volume resistance ratio of $1\times10^8$ Ω·cm. Rz of the intermediate transfer member was 0.9 μm.

Primary Transfer Condition

A primary transfer roller (5Y, 5M, 5C, 5K of FIG. 1 (each having 6.05 mm diameter)): the structure in which a metal core was provided with elastic gum: Surface specific resistance $1\times10^6$ Ω, and a transfer voltage was applied.

Secondary Transfer Condition

A back-up roller 74 and a secondary transfer roller 5A were disposed to put an endless belt-shaped intermediate transfer member 70 as the intermediate transfer member therebetween, the resistance value of the back-up roller 74 is $1\times10^6$ Ω, the resistance value of the secondary transfer roller as a secondary transfer means is $1\times10^6$ Ω, and a constant current control (about 80 μA) was conducted.

Fixing is a heat fixing method by a fixing roller in which a heater was arranged inside of a roller. A distance Y on an intermediate transfer member from the first contact point between the intermediate transfer member and a photoreceptor to the first contact point between the intermediate transfer member and a photoreceptor for a next color was made 95 mm.

The outer circumferential length (circumferential length) of drive roller 71, guide roller 72, 73 and back-up roller 74 for use in secondary transfer was made 31.67 mm (=95 mm/3), and the outer circumferential length of tension roller 76 was made 23.75 mm (=95 mm/4). And, the outer circumferential length of a primary transfer roller was made 19 mm (=95 mm/5).

Cleaning Blade (Photoreceptor)

A cleaning brush: conductive acryl resin, bristles density of $3\times10^3/cm^2$, bite-in amount (deformed amount) of 0.8 mm A secondary transfer roller (5A of FIG. 1): the structure in which a metal core was provided with elastic gum. : a transfer voltage was applied.

Cleaning blade (intermediate transfer member)

TABLE 2

| Combination No. | Photoreceptor No. | Surface energy lowering agent (Water content: weight %) | Photoreceptor Surface water content: weight % | Intermediate transfer member No. (Surface water content: weight %) | Contact angle of the photoreceptor | Contact angle of the intermediate transfer member | Lacking of partial toner image | Scattering of character image | Cleaning ability | Image density | Sharpness | Remarks |
|---|---|---|---|---|---|---|---|---|---|---|---|---|
| 1 | 1 | *A(0.1) | 0.1 | 1(0.5) | 112° | 110 | AA | AA | AA | AA | AA | Inv. |
| 2 | 1 | *A(0.1) | 0.1 | 5(0.05) | 112° | 83 | C | c | AA | AA | A | Comp. |
| 3 | 1 | *B(1.0) | 1.0 | 4(3.0) | 112° | 83 | AA | AA | AA | AA | AA | Inv. |
| 4 | 1 | *C(2.5) | 2.5 | 4(3.0) | 110° | 83 | AA | AA | AA | AA | AA | Inv. |
| 5 | 1 | *B(1.0) | 1.0 | 2(0.6) | 112° | 85 | C | C | AA | AA | A | Comp. |

TABLE 2-continued

| Combination No. | Photoreceptor No. | Surface energy lowering agent (Water content: weight %) | Photoreceptor Surface water content: weight % | Intermediate transfer member No. (Surface water content: weight %) | Contact angle of the photoreceptor | Contact angle of the intermediate transfer member | Lacking of partial toner image | Scattering of character image | Cleaning ability | Image density | Sharpness | Remarks |
|---|---|---|---|---|---|---|---|---|---|---|---|---|
| 6 | 1 | *B(1.0) | 1.0 | 3(1.1) | 112° | 85 | AA | AA | AA | AA | AA | Inv. |
| 7 | 1 | *C(2.5) | 2.5 | 6(5.2) | 110° | 81 | A | A | AA | AA | AA | Inv. |
| 8 | 1 | *D(4.5) | 4.5 | 6(5.2) | 106° | 81 | A | A | AA | AA | A | Inv. |
| 9 | 1 | *E(5.5) | 5.5 | 6(5.2) | 101° | 81 | C | C | A | A | A | Comp. |
| 10 | 1 | *F(0.8) | 0.8 | 1(0.5) | 105° | 110 | C | C | A | A | A | Comp. |
| 11 | 1 | *F(0.8) | 0.8 | 3(1.1) | 105° | 85 | AA | AA | AA | AA | AA | Inv. |
| 12 | 2 | *B(1.0) | 1.0 | 4(3.0) | 102° | 83 | AA | AA | AA | AA | AA | Inv. |
| 13 | 2 | *C(2.5) | 2.5 | 4(3.0) | 110° | 83 | AA | AA | AA | AA | AA | Inv. |
| 14 | 2 | *B(1.0) | 1.0 | 2(0.6) | 112° | 85 | C | C | A | A | A | Inv. |
| 15 | 2 | *B(1.0) | 1.0 | 3(1.1) | 112° | 85 | AA | AA | AA | AA | AA | Inv. |

*To photoreceptor
Inv.: Inventive
Comp.: Comparative

As can be appreciated from Table 2, a combination according to the examples that water content of a photoreceptor surface is smaller than water content of intermediate transfer member, such as a combination of 1, 3, 4, 6, 7, 8, 11, 12, 13, or 15, shows good evaluation result in lacking of partial toner image or scattering of character image, in comparison with a combination of 2, 5, 9, 10, or 14.

As shown in the examples, an improvement of a toner transfer characteristic of an electrophotographic method with the use of an intermediate transfer member can be achieved, an image defect such as lacking of partial toner image and scattering of character image caused by the lowering of toner transfer can be prevented, and an electrophotographic method type image forming device having a good cleaning characteristic can be offered.

What is claimed is:

1. An image forming apparatus, comprising:

an electrophotographic photoreceptor; and an intermediate transfer member to which a toner image formed on the photoreceptor is transferred, wherein the photoreceptor and the intermediate transfer member have a condition represented by Formula 1:

$$Wa<Wb$$

where Wa represents a water content (wt %) on the surface of the photoreceptor and Wb represents a water content (wt %) on the surface of the intermediate transfer member.

2. The image forming apparatus of claim 1, wherein Wa and Wb have the following relation:

$$Wa<Wb<5.0 \text{ wt \%}.$$

3. The image forming apparatus of claim 2, wherein when a contact angle of the photoreceptor and the intermediate transfer member for pure water is A and B respectively, A and B have the following relation:

$$B<A.$$

4. The image forming apparatus of claim 3, comprising an agent supplying device which supplies a surface energy lowering agent to the surface of the photoreceptor.

5. The image forming apparatus of claim 4, wherein the surface energy lowering agent comprises a fatty acid metal salt.

6. The image forming apparatus of claim 5, wherein the water content of the surface energy lowering agent is 5.0 wt % or less.

7. The image forming apparatus of claim 5, wherein the water content of the surface energy lowering agent is 0.05 to 3 wt %.

8. The image forming apparatus of claim 5, wherein the surface of the intermediate transfer member has a ten point surface roughness of 0.5 to 2 μm.

9. The image forming apparatus of claim 8, wherein the water content of the surface energy lowering agent is 5.0 wt % or less.

10. The image forming apparatus of claim 9, wherein a particle having a number average particle diameter of 0.05 to 8 μm is contained in the surface of photoreceptor.

11. The image forming apparatus of claim 4, wherein the surface energy lowering agent includes at least one of fatty acid metal salt, fluorinated resin containing fluorine atom and a combination of the fatty acid metal salt and the fluorinated resin.

12. The image forming apparatus of claim 1, comprising a first transfer member to transfer the toner image from the photoreceptor to the intermediate transfer member, and a second transfer member to transfer the toner image on the photoreceptor to another intermediate transfer member or an image support.

13. An image forming method, comprising:

transferring a toner image formed on an electrophotographic photoreceptor to an intermediate transferring member, wherein the photoreceptor and the intermediate transfer member have a condition represented by Formula 1:

$$Wa<Wb$$

where Wa represents a water content (wt %) on the surface of the photoreceptor and Wb represents a water content (wt %) on the surface of the intermediate transfer member.

14. The image forming method of claim 13, wherein Wa and Wb have the following relation:

$$Wa<Wb<5.0 \text{ wt \%}.$$

15. The image forming method of claim 13, wherein when a contact angle of the photoreceptor and the intermediate transfer member for pure water is A and B respectively, A and B have the following relation:

$B<A$.

16. The image forming method of claim 13, comprising: supplying a surface energy lowering agent on the surface of the photoreceptor.

17. The image forming method of claim 13, wherein the surface energy lowering agent includes at least one of fatty acid metal salt, fluorinated resin containing fluorine atom and a combination of the fatty acid metal salt and the fluorinated resin.

18. The image forming method of claim 13, wherein the surface energy lowering agent is a fatty acid metal salt or zinc stearate, wherein Wa and Wb have the following relation:

$Wa<Wb<5.0$ wt %, and when a contact angle of the photoreceptor and the intermediate transfer member for pure water is A and B respectively, A and B have the following relation:

$B<A$.

19. The image forming method of claim 18, wherein the water content of the surface energy lowering agent is 0.05 to 3 wt %.

* * * * *